US005996914A

United States Patent [19]

Stehr

[11] Patent Number: 5,996,914

[45] **Date of Patent: *Dec. 7, 1999**

[54] AGITATOR MILL

[75] Inventor: Norbert Stehr, Grünstadt, Germany

[73] Assignee: Draiswerke GmbH, Mannheim, Germany

[ * ] Notice: This patent is subject to a terminal disclaimer.

[21] Appl. No.: 09/184,591

[22] Filed: Nov. 3, 1998

[30] Foreign Application Priority Data

Aug. 17, 1998 [DE] Germany ..... 298 14 714 U

[51] Int. Cl.[6] ..... B02C 17/16

[52] U.S. Cl. ..... 241/171; 241/172

[58] Field of Search ..... 241/171, 172, 241/46.17, 46.11

[56] References Cited

U.S. PATENT DOCUMENTS 5,062,577 11/1991 Schmitt et al. .
5,133,508 7/1992 Stehr et al. .
5,897,068 4/1999 Stehr ..... 241/172

FOREIGN PATENT DOCUMENTS 28 11 899 6/1984 Germany .
38 44 380 1/1990 Germany .

*Primary Examiner*—Mark Rosenbaum
*Attorney, Agent, or Firm*—Browdy and Neimark

[57] ABSTRACT

An agitator mill comprises an annular cylindrical exterior grinding chamber, which is defined by an interior wall of a grinding receptacle and an outer wall of a rotor, and an interior grinding chamber, which is defined by an inner wall of the rotor and an outer jacket of an interior stator. The grinding chambers are connected with each other by a deflection chamber. An annular cylindrical eddy gap, which is defined by the rotor and the interior wall of the grinding receptacle and into which open the bypasses, is formed between a grinding stock supply chamber, which is disposed up-stream of the exterior grinding chamber, and the exterior grinding chamber.

5 Claims, 2 Drawing Sheets

59
7
16
22
48
17
15
53
18
19
21
52
e
57
54
34
62
47
55
65
46
20
56
32
64
33
61
58
41
36
63
40
42
12
35
44
43
11
45
Da
10
24
45
26
3
27
9
50
Di
9'
28
51
b
da
a
di
31
9"
c
52
60
41
49
14
13
30
29
39
38
30a

AGITATOR MILL

BACKGROUND OF THE INVENTION

1. Field of the Invention

The invention relates to an agitator mill for the treatment of free flowing grinding stock, comprising a grinding receptacle, an interior wall of which defines a substantially closed grinding chamber; and an agitator unit, which is disposed rotatingly drivably in the grinding receptacle and is cup-shaped relative to a common central longitudinal axis and which comprises an annular cylindrical rotor, within which an interior stator is disposed, tightly joined to the grinding receptacle; an annular cylindrical exterior grinding chamber being formed between the interior wall of the grinding receptacle and an outer wall of the rotor, and an annular cylindrical interior grinding chamber, which is disposed coaxially within the exterior grinding chamber and is connected with the latter by way of a deflection chamber, being formed between an inner wall of the rotor and an outer jacket of the interior stator; agitator elements being mounted on the outer wall of the rotor, which project into the exterior grinding chamber; the exterior grinding chamber, the deflection chamber and the interior grinding chamber constituting the grinding chamber partially filled with auxiliary grinding bodies; a grinding stock supply chamber, which is disposed upstream of the exterior grinding chamber and opens into the latter in the direction of flow of the grinding stock, and a separating device, which is disposed downstream of the interior grinding chamber in the direction of flow of the grinding stock, being disposed approximately on the same side of the grinding receptacle for the grinding stock to pass through; and bypasses being provided in the agitator unit for the return of the auxiliary grinding bodies from the vicinity of the separating device into the vicinity of the grinding stock supply chamber, the bypasses connecting the end of the interior grinding chamber with the beginning of the exterior grinding chamber.

2. Background Art

An agitator mill of the generic type is known from U.S. Pat. No. 5,062,577. In this known agitator mill, pin-type agitator elements are mounted on the limiting walls of the exterior grinding chamber and at least on the inner limiting wall of the interior grinding chamber, by means of which alternate acceleration and deceleration of the auxiliary grinding bodies takes place, which leads to a turbulent-flow condition having a grinding and dispersing effect predominantly by impact. The grinding stock flows through a grinding-stock supply chamber, through a transition portion, past the bypasses into the exterior grinding chamber, and through the deflection chamber into the interior grinding chamber. The auxiliary grinding bodies circulate through the exterior grinding chamber, the deflection chamber, the interior grinding chamber and the bypasses back into the exterior grinding chamber or the transition portion opening into the latter, respectively. The grinding stock flows from the end of the interior grinding chamber to the separating device. The separating device does not considerably serve to separate the auxiliary grinding bodies on the one hand from the grinding stock on the other; nevertheless, the term separating device is used in this application too, because it is generally accepted in the technical language. As results from the above explanation, separating the auxiliary grinding bodies from the grinding stock takes place already upstream of the separating device. The known agitator mill has been extraordinarily successful in practice.

An agitator mill is known from DE 28 11 899 C, of which the exterior grinding chamber on the one hand and the interior grinding chamber on the other each taper in the shape of a truncated cone, i.e. the cross-section of the grinding chamber is conical on each side of the central longitudinal axis of the rotor and the stator. The grinding stock flows through the agitator mill from the inside to the outside, i.e. it flows into the interior grinding chamber where the latter has its narrowest diameter, then it passes through the radially expanding interior grinding chamber, the deflection chamber and the radially expanding exterior grinding chamber. From there, it flows radially inwards through a chamber unilaterally defined by the agitator element and towards a separating device, through which the grinding stock is discharged. The inlet of a bypass is disposed downstream of this separating device, the inlet of this bypass being disposed radially within the separating device, i.e. disposed downstream of the latter. From there, the auxiliary grinding bodies flow through bypasses in the rotor into the starting portion of the interior grinding chamber. The limiting walls of the grinding chamber are smooth. The width of the grinding gap, i.e. the radial with of the grinding chamber, is constant; however, the distance towards the axis of rotation increases steadily. This results in the fact that the shear gradient increases from the inside to the outside along the path of the grinding stock. This means that either it is too low in the interior grinding chamber or too high in the exterior grinding chamber, which leads to irregular load exerted on the grinding stock. (The shear gradient is defined as the quotient of the speed of the rotating surface and the gap width.)

DE 38 44 380 C1 teaches an agitator mill which possesses an agitator shaft with a cage that is part of the agitator shaft. The cage is mounted on a support, a friction gap being formed between this support and the cover of the grinding receptacle and a neighboring portion of the inside wall of the grinding receptacle. In this friction gap, the grinding stock is activated by the friction of the walls of the grinding receptacle and the agitator shaft which define these friction gaps.

SUMMARY OF THE INVENTION

It is the object of the invention to embody an agitator mill of the generic type such that intensive comminution and dispersion of the grinding stock particles is further improved.

According to the invention, this object is attained by the features which consist in that an annular cylindrical eddy gap is formed between the grinding stock supply chamber and the exterior grinding chamber, which is defined by the rotor and the interior wall of the grinding receptacle and into which the bypasses discharge by outlets. The grinding stock, prior to entering the exterior grinding chamber, is subjected to pre-dispersion in a narrow, annular cylindrical eddy gap. This effect is produced in particular by the annular cylindrical eddy gap having a rather inferior extension radial to the central longitudinal axis and that the bypasses open into this eddy gap so that wall sections of the rotor that define the eddy gap and the outlets of the bypasses alternately run past the interior wall of the grinding chamber.

Further features, advantages and details of the invention will become apparent from the ensuing description of an exemplary embodiment of the invention, taken in conjunction with the drawing.

DESCRIPTION OF THE PREFERRED EMBODIMENT

Figure 1:
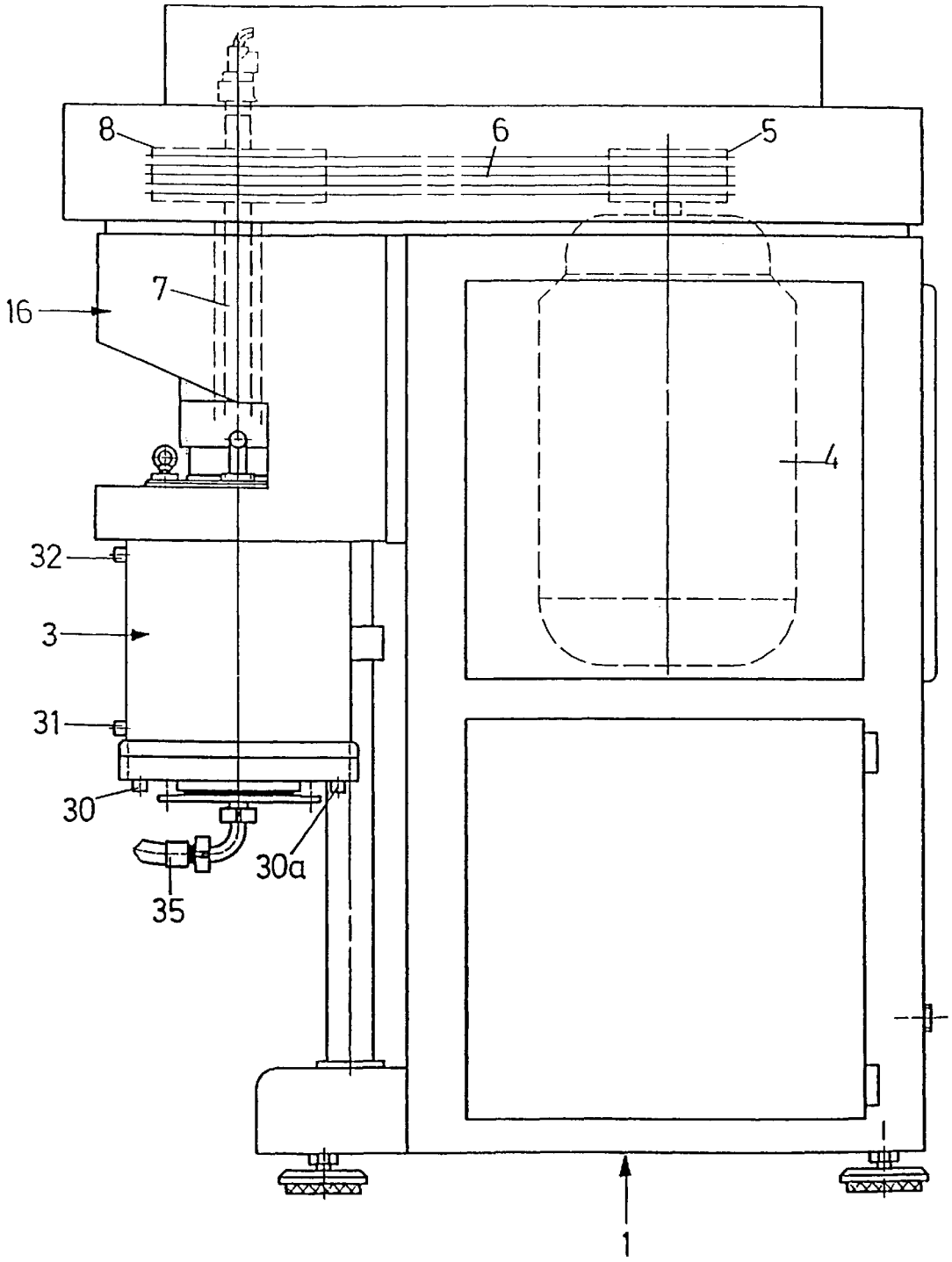
FIG. 1 is a diagrammatic illustration of an agitator mill in a lateral view.

The agitator mill seen in FIG. 1 customarily comprises a stand 1 on which to mount a cylindrical grinding receptacle 3. An electric driving motor 4 is housed in the stand 1 and is provided with a V-belt pulley 5 by means of which a V-belt pulley 8 can be driven in rotation by way of V-belts 6, the V-belt pulley 8 being non-rotatably united with a driving shaft 7.

Figure 2:
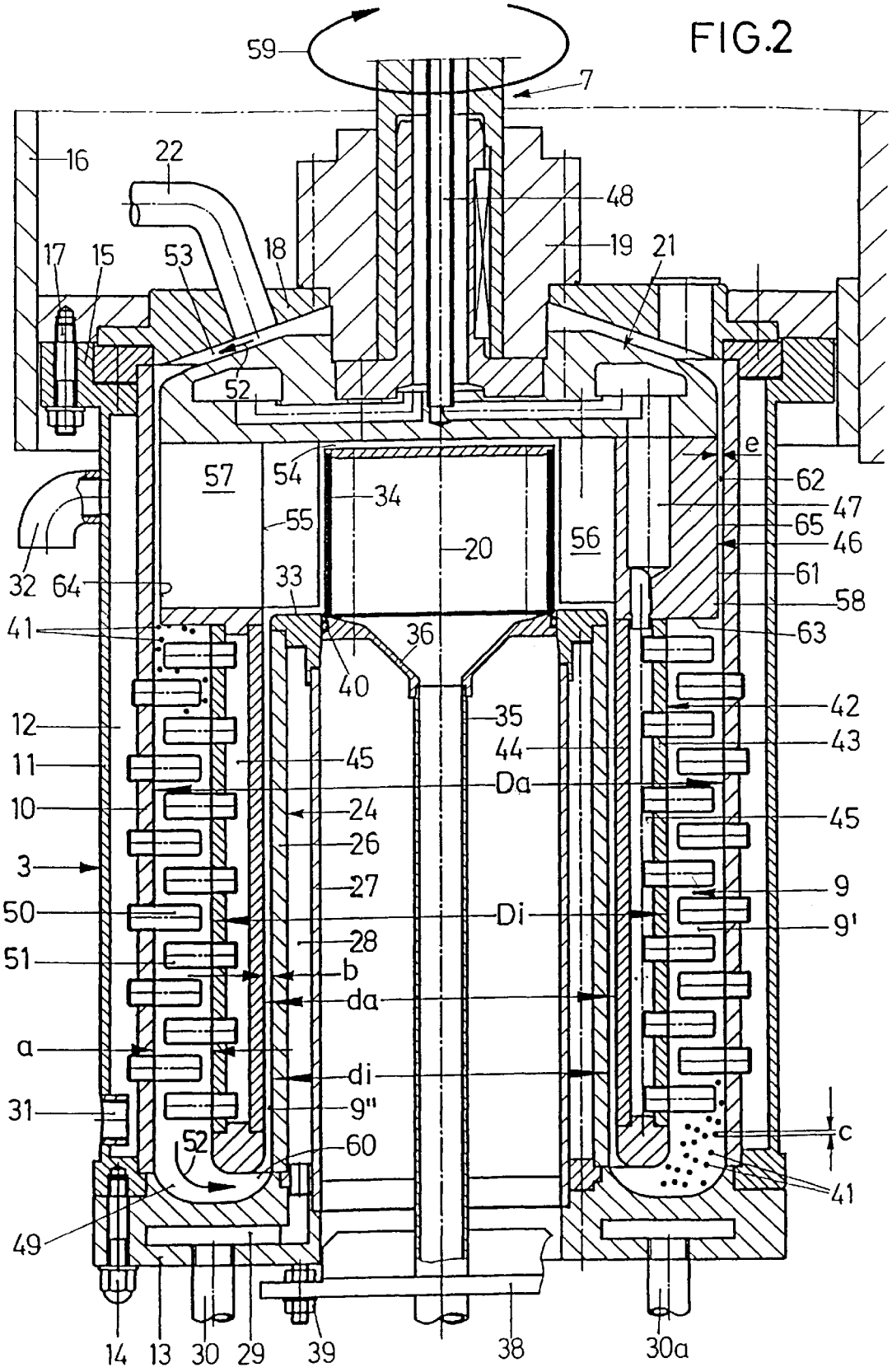
FIG. 2 is a lengthwise section through the grinding receptacle of the agitator mill.

As seen in particular in FIG. 2, the grinding receptacle 3 consists of a cylindrical interior wall 10 which surrounds a grinding chamber 9 and which is enveloped by a substantially cylindrical outer jacket 11. Between them, the interior cylinder 10 and the outer jacket 11 define a cooling chamber 12. The lower end of the grinding chamber 9 is formed by a bottom plate 13 in the form of a circular ring which is fixed to the grinding receptacle by means of screws 14.

The grinding receptacle 3 comprises an upper annular flange 15, by means of which it is fixed to the underside of a carrying housing 16 by way of screws 17, the carrying housing 16 being attached to the stand 1 of the agitator mill. The grinding chamber 9 is closed by means of a cover 18. The carrying housing 16 possesses a central bearing and sealing housing 19 which is disposed coaxially to the central longitudinal axis 20 of the grinding receptacle 3. The driving shaft 7 passes through this sealing housing 19, the shaft 7 equally being coaxial to the axis 20 and having an agitator unit 21 attached to it. A grinding stock supply line 22 opens into the portion of the sealing housing 19 that adjoins the grinding chamber 9.

An approximately cup-shaped, cylindrical interior stator 24 is fixed to the bottom plate 13 in the form of an annulus, projecting into the grinding chamber 9 and comprising a cylindrical outer jacket 26, which is coaxial to the axis 20 and defines the grinding chamber 9, and a cylindrical inner jacket 27, which is also coaxial to the axis 20. The outer jacket 26 and the inner jacket 27 define between them a cooling chamber 28. The cooling chamber 28 is connected with a cooling chamber 29 in the bottom plate 13, cooling water being supplied to the cooling chamber 29 by way of a cooling water supply connector 30 and discharged by way of a cooling water discharge connector 32.

A grinding stock/auxiliary grinding body separating device 34 is disposed on the upper front side 33, located above the grinding chamber 9, of the interior stator 24 and is connected with a grinding stock discharge line 35. A grinding stock collecting hopper 36 is provided between the separating device 34 and the discharge line 35. In the vicinity of the bottom plate 13, the discharge line 35 is provided with a holding bow 38 which, by means of screws 39, is detachably joined to the bottom plate 13 and the interior stator 24 that is fightly connected with the latter. The separating device 34 is sealed towards the annular front side 33 of the interior stator 24 by means of a seal 40 and, together with the discharge line 35 and the collecting hopper 36, can be pulled downwards out of the interior stator 24 once he screws 39 are loosened. The separating device 34 can be pulled out of he grinding chamber 9 without the auxiliary grinding bodies 41 housed therein having to be removed from the grinding chamber, since the level of filling of the grinding chamber 9 with these auxiliary grinding bodies 41 does not reach as far as to the front side 33 when the agitator unit 21 is not driven.

The basic structure of the agitator unit 21 is cup-shaped, i.e. the latter comprises a substantially annular cylindrical rotor 42 which is formed by a cylindrical outer wall 43 and a cylindrical inner wall 44 disposed coaxially thereto and coaxially to the axis 20. A cooling chamber 45 is formed between the outer wall 43 and the inner wall 44 of the rotor 42. The rotor 42 is mounted on a rotor carrying member 46 which is joined to the shaft 7. The cooling water supply to, and its discharge from, the cooling chamber 45 takes place by way of cooling water channels 47, 48 formed in the shaft 7 and in the rotor carrying member 46. By means of the smooth-walled interior cylinder 10 of the grinding receptacle 3 and the smooth cylindrical outer wall 43 of the rotor 42 on the one hand, and by means of the cylindrical smooth inner wall 44 of the rotor 42 and the cylindrical smooth-walled outer jacket 26 of the interior stator 24 on the other hand, the grinding chamber 9 is divided into a cylindrical exterior grinding chamber 9' one the one hand and a cylindrical interior grinding chamber 9" on the other hand, the two being connected with each other by a deflection chamber 49 in the vicinity of the bottom plate 13.

On the walls defining the grinding chamber which are constituted by the interior cylinder 10 and the outer wall 43, provision is made for stationary agitator elements 50, which project into the exterior grinding chamber 9', and agitator elements 51 rotatable together with the rotor 42. By contrast, no agitator elements that project into the interior grinding chamber 9" are mounted on the walls defining the grinding chamber which are constituted by the inner wall 44 and the outer jacket 26. The grinding stock flows through the grinding chamber 9 in accordance with the arrows 52 of flow direction, coming from the grinding stock supply line 22, through a grinding stock supply chamber 53 between the rotor carrying member 46 on the one hand and the cover 18 and the neighboring portion of the interior wall 10 on the other, through the exterior grinding chamber 9' downwards, through the deflection chamber 49 radially inwards, and from there through the interior grinding chamber 9" upwards as far as to the separating device 34. On its way through the exterior grinding chamber 9', the deflection chamber 49 and the interior grinding chamber 9", the grinding stock is ground while the agitator unit 21 is driven in rotation, cooperating with the auxiliary grinding bodies 41. The grinding stock leaves the grinding chamber 9 through the separating device 34, from where it discharges through the grinding stock discharge line 35.

The separating device 34, which serves for separating the auxiliary grinding bodies 41, is disposed in a cylindrical recess 54 of the rotor carrying member 46. Between the cylindrical wall 55 of the recess 54 and the separating device 34, elongated drivers 56 are mounted on the wall 55, which are approximately triangular in cross-sectional shape and which, between themselves, form inlet portions of approximately hopper-type cross-sectional shape for bypasses 57. A design of this type with these drivers 56 is known from U.S. No. Pat. 5,133,508.

The bypasses 57 are situated in the rotor carrying member 46, i.e. in the portion of transition of the rotor carrying member 46 to the cylindrical rotor 42 and—seen in the direction of the arrows of flow direction 52—before the separating device 34. Related to the flow direction corresponding to the arrows of flow direction 52, they connect the end of the interior grinding chamber 9" with the beginning of the exterior grinding chamber 9', i.e. with a transition portion 58 of the grinding stock supply chamber 53 which passes into the exterior grinding chamber 9'. Related to the direction of rotation 59 of the agitator unit 21, the bypasses 57 extend radially from the inside to the outside against the direction of rotation 59 so that the auxiliary grinding bodies 41, which are provided with centrifugal acceleration in the interior grinding chamber 9", are catapulted off through the bypasses 61 and thus returned again into the grinding stock supply chamber 53.

With the agitator elements 51 mounted on the rotor 42 and the stationary counterpart agitator elements 50 mounted on the grinding receptacle 3, the exterior grinding chamber 9' is a genuine grinding chamber in which the auxiliary grinding bodies 41 are exposed to intensive momentum exchange with the rotating agitator elements 51 and the stationary agitator elements 50, i.e. in which the grinding stock is subjected to an intensive shearing and dispersing process by impact effects. The individual particles of the grinding stock supplied in the form of a dispersion or suspension are intensively comminuted in the exterior grinding chamber 9'. As opposed to this, the interior grinding chamber 9" is embodied as a grinding gap, the cross-sectional surface of which is considerably smaller than the cross-sectional surface of the exterior grinding chamber 9'. The exterior grinding chamber 9' possesses an outside diameter Da and an inside diameter Di. The interior grinding chamber 9" in the form of a grinding gap possesses an outside diameter da and an inside diameter di.

15 mm≦a applies to the width a of the exterior grinding chamber 9' radial to the axis 20. a≦40 mm is the upper limit. As regards the gap width b of the interior grinding chamber likewise radial to the axis 20, 10 mm≦b applies. b≦24 mm is the upper limit. As an upper limit c≦1.5 mm applies to the diameter c of the auxiliary grinding bodies 41. Attention is drawn to the fact that the illustration in the drawing of the width a of the exterior grinding chamber 9' and of the width b of the interior grinding chamber 9" does not completely correspond to the given dimensions. However, the principle of the illustration in the drawing is correct.

The deflection chamber 49 is provided with an acceleration section 60 which tapers continuously towards the interior grinding chamber.

The agitator mill described can be disposed vertically or horizontally, i.e. it may have a vertical central longitudinal axis—as described—or a correspondingly horizontal central longitudinal axis. In particular in the case of a horizontal arrangement of the agitator mill the drivers 56 are not necessary. for instance agitator elements corresponding to the agitator elements 50 can be mounted also in the interior grinding chamber 9", in particular on the interior stator. Of course, further constructional adaptations may be necessary.

Disposed between the cylindrical circumferential wall 61 and the associated interior wall 10 of the grinding receptacle 3 is an eddy gap 62 into which opens the portion, in the shape of a truncated cone, of the grinding stock supply chamber 53. The bypasses 57 open into the eddy gap 62. At the transition portion 58 of the rotor carrying member 46, the bypasses 57 are closed by a boundary 63 so that in the transition portion 58, the auxiliary grinding bodies 41 may not enter the exterior grinding chamber 9" directly, but only the eddy gap 62.

The gap width e of the eddy gap 62 radial to the central longitudinal axis 20 is very small, 3 mm≦e≦8 mm, and in particular 4 mm≦e≦5 mm applying.

Further, as regards the ratio that the gap width e bears to the diameter c of the auxiliary grinding bodies 41, 3 c≦e≦4c holds good.

The bypasses 57 can expand on the whole further in the direction toward the deflection chamber 49, i.e. they can partially overlap the—in FIG. 2 upper—portion of the interior stator 24, i.e. not only the separating device 34. In this way also the eddy gap 62 would be prolonged correspondingly.

Since the eddy gap 62 has a narrow cross-section in relation to the exterior grinding chamber 9', the flow rate of the grinding stock in the eddy gap 62 is high in the direction toward the exterior grinding chamber 9', precluding any escape of the auxiliary grinding bodies 41 into the portion, in the shape of a truncated cone, of the grinding stock supply chamber 53. In other words, the flow rate of the grinding stock in the exterior grinding chamber 9' is distinctly less than in the eddy gap 62. In particular the fact that the wall sections 65 of the circumferential wall 61, which are interrupted by the respective outlet 64 of the bypasses 57, alternate with the bypasses 57, which form sort of a setback, serves to attain extremely intensive turbulent mixing of the auxiliary grinding bodies 41, which leads to an extraordinarily intensive pre-dispersion of the grinding stock in the eddy gap 62.

What is claimed is:

1. An agitator mill for the treatment of free flowing grinding stock, comprising a grinding receptacle (3), an interior wall (10) of which defines a substantially closed grinding chamber (9);

an agitator unit (21), which is disposed rotatingly drivably in the grinding receptacle (3) and is cup-shaped relative to a common central longitudinal axis (20) and which comprises an annular cylindrical rotor (42), within which an interior stator (24) is disposed, tightly joined to the grinding receptacle (3);

an annular cylindrical exterior grinding chamber (9') formed between the interior wall (10) of the grinding receptacle (3) and an outer wall (43) of the rotor (42);

an annular cylindrical interior grinding chamber (9") formed between an inner wall (44) of the rotor (42) and an outer jacket (26) of the interior stator (24) and disposed coaxially within the exterior grinding chamber (9'); a deflection chamber (49) connecting the exterior grinding chamber (9') with the interior grinding chamber (9");

agitator elements (51) mounted on the outer wall (43) of the rotor (42), which project into the exterior grinding chamber (9'), wherein the exterior grinding chamber (9'), the deflection chamber (49) and the interior grinding chamber (9") constitute the grinding chamber (9) partially filled with auxiliary grinding bodies (41);

a grinding stock supply chamber (53), which is disposed upstream of, and opens into, the exterior grinding chamber (9') in the direction of flow (52) of the grinding stock;

a separating device (34), which is disposed downstream of the interior grinding chamber (9") in the direction of flow (52) of the grinding stock, and which is arranged approximately on the same side of the grinding receptacle (3) as the grinding stock supply chamber (53), for the grinding stock to pass through; and bypasses (57) provided in the agitator unit (21) for the return of the auxiliary grinding bodies (41) from the vicinity of the separating device (34) into the vicinity of the grinding stock supply chamber (53), the bypasses (57) connecting the end of the interior grinding chamber (9") with the beginning of the exterior grinding chamber (9');

wherein an annular cylindrical eddy gap (62) is formed between the grinding stock supply chamber (53) and the exterior grinding, chamber (9'), which is defined by the rotor (42) and the interior wall (10) of the grinding receptacle (3) and into which the bypasses (57) discharge by outlets (64).

2. An agitator mill according to claim 1, wherein the rotor (42) defines the eddy gap (62) by a cylindrical circumferential wall (61) in which the outlets (64) of the bypasses (57) are located, the outlets (64) and wall sections (65) of the circumferential wall (61) alternating in the circumferential direction of the rotor (42).

3. An agitator mill according to claim 1, wherein 3 mm$\leqq$e$\leqq$8 mm applies to the gap width e of the eddy gap (62) between the circumferential wall (61) and the interior wall (10) of the grinding receptacle (3) radial to the central longitudinal axis (20).

4. An agitator mill according to claim 3, wherein 4 mm$\leqq$e$\leqq$5 mm applies to the gap width e.

5. An agitator mill according to claim 3, wherein 3 c$\leqq$e$\leqq$4 c applies to the gap width e in relation to the diameter c of the auxiliary grinding bodies (41).

* * * * *